US009303654B2

(12) United States Patent
Felix

(10) Patent No.: US 9,303,654 B2
(45) Date of Patent: Apr. 5, 2016

(54) METHOD FOR THE PRESSURE REGULATION OF A BARRIER FLUID AND A PUMPING DEVICE FOR A METHOD OF THIS KIND

(75) Inventor: Thomas Felix, Zumikon (CH)

(73) Assignee: Sulzer Management AG, Winterthur (CH)

( * ) Notice: Subject to any disclaimer, the term of this patent is extended or adjusted under 35 U.S.C. 154(b) by 1658 days.

(21) Appl. No.: 12/599,808

(22) PCT Filed: Apr. 25, 2008

(86) PCT No.: PCT/EP2008/055075
§ 371 (c)(1),
(2), (4) Date: Sep. 23, 2011

(87) PCT Pub. No.: WO2008/138730
PCT Pub. Date: Nov. 20, 2008

(65) Prior Publication Data

US 2012/0027564 A1 Feb. 2, 2012

(30) Foreign Application Priority Data

May 15, 2007 (EP) ..... 07108274

(51) Int. Cl.
*F04D 29/10* (2006.01)
*F04D 29/12* (2006.01)

(52) U.S. Cl.
CPC ..... *F04D 29/108* (2013.01); *F04D 29/128* (2013.01)

(58) Field of Classification Search
CPC ..... F04D 29/108; F04D 29/128
USPC ..... 415/104, 107, 110, 111, 112, 168.1, 415/168.2; 277/408, 431
See application file for complete search history.

(56) References Cited

U.S. PATENT DOCUMENTS 2,332,150 A 10/1943 Huff
4,078,809 A * 3/1978 Garrick et al. ..... 277/304
(Continued)

FOREIGN PATENT DOCUMENTS

DE 66 05 674 U 6/1970
DE 33 47 263 A1 7/1985

OTHER PUBLICATIONS

Huebner, Michael B., "Overview of API 682 and ISO 21049," *Flowserve Corporation*, Turbomachinery Lab and Texas A&M University, Baltimore Convention Centre, pp. 131-137 (Mar. 11, 2004).

*Primary Examiner* — Richard Edgar
(74) *Attorney, Agent, or Firm* — Kilpatrick Townsend & Stockton LLP

(57) ABSTRACT

A method for the pressure regulation of a barrier fluid in a pumping device (10) is introduced, which includes a pump unit (11) with a shaft (12) and a pump housing (13), a drive unit (17), which is mechanically coupled to the pump unit and a shaft sealing arrangement (16.1, 16.2), which seals the pump housing (13) relative to the shaft (12). In the method, a pumping medium is pumped by means of the pumping device (10) and the barrier fluid is conveyed via a feed line (5.1, 5.2) to a common housing (18), in which the pump unit (11) and the drive unit (17) are arranged, in order to prevent a leakage of the pumping medium out of the pump housing (13). Additionally, the pressure of the supplied barrier fluid is increased when a pressure difference between the pressure of the supplied barrier fluid and a detected pressure of the pumping medium in the pump unit (11) falls below a pre-determined value. For this purpose a pressure reducing valve (1) for the differential-pressure is opened and the feed line is connected through to a source (3, 4) for the barrier fluid via the open valve, the pressure of which lies by more than the pre-determined value above the pressure of the pumping medium in the pump unit.

11 Claims, 1 Drawing Sheet

(56) References Cited

U.S. PATENT DOCUMENTS 5,375,853 A * 12/1994 Wasser et al. ..... 277/366
5,746,435 A * 5/1998 Arbuckle ..... 277/304
5,769,427 A 6/1998 Ostrowski
6,471,494 B1 * 10/2002 Miura et al. ..... 417/410.4

* cited by examiner

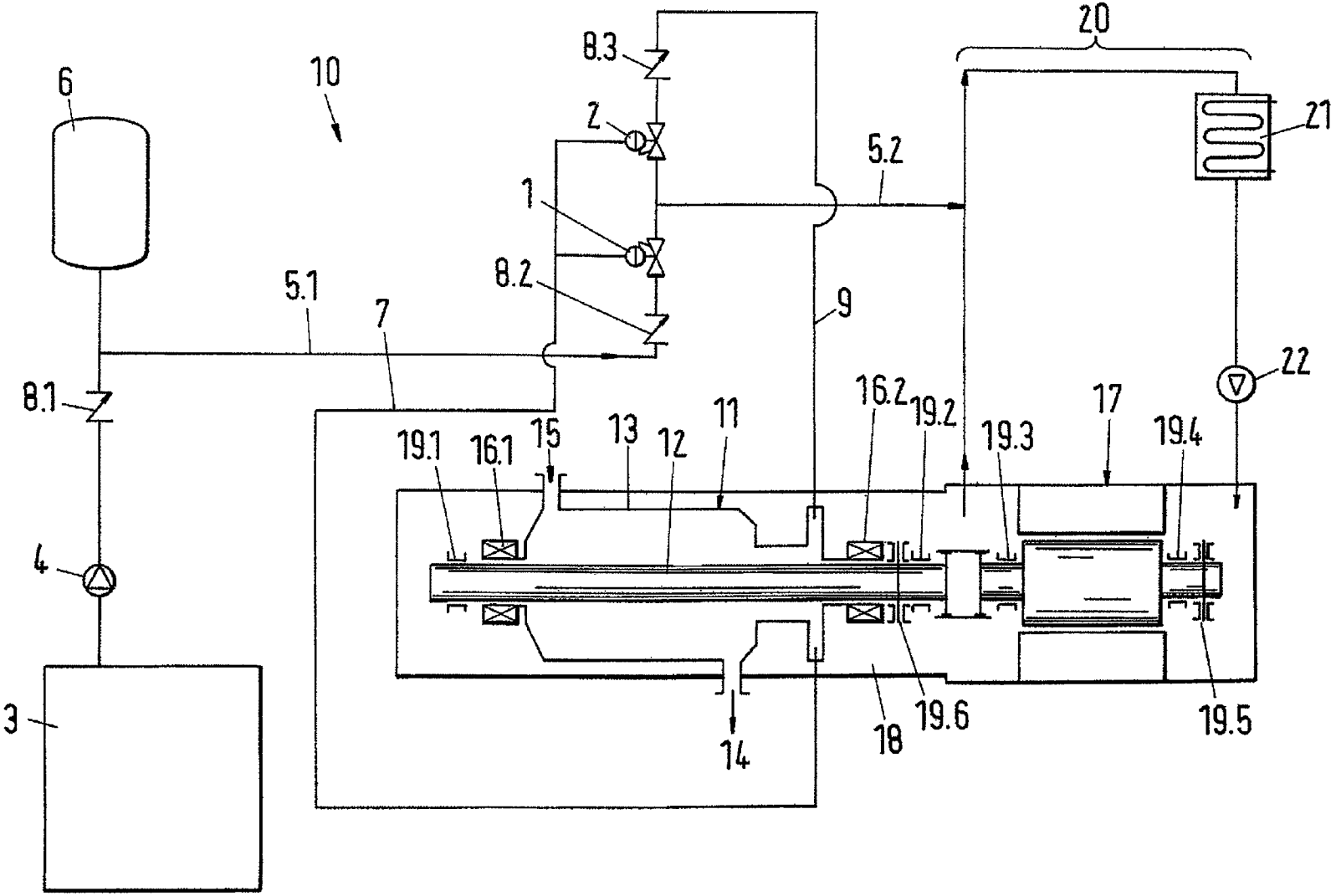
21
22
20
19.5
19.4
17
19.3
19.2
19.6
16.2
18
5.2
9
11
14
12
13
8.3
2
1
8.2
15
16.1
19.1
7
10
5.1
6
8.1
4
3

METHOD FOR THE PRESSURE REGULATION OF A BARRIER FLUID AND A PUMPING DEVICE FOR A METHOD OF THIS KIND

CROSS-REFERENCE TO RELATED APPLICATIONS

This application is a National Stage of International Application No. PCT/EP2008/055075 filed Apr. 25, 2008, and which claims the benefit of European Patent Application No. 07108274.7, filed May 4, 2007, the disclosures of which are incorporated herein by reference.

BACKGROUND OF THE INVENTION

The invention relates to a method for the pressure regulation of a barrier fluid in a pumping device in accordance with the pre-characterising part of the claims herein and a pumping device for a method of this kind in accordance with the pre-characterising part of the claims herein.

Pumping devices for pumping media such as fluids for example, as a rule include a pump unit with a shaft and with a pump housing and a drive unit which is mechanically coupled to the pump unit and also a shaft sealing arrangement which seals the pump housing relative to the shaft. High demands are made on the shaft sealing arrangement if the pump unit and the drive unit are arranged in a common housing or pressure container. Serious damage can arise at the pumping device if the pumping medium which, depending on the use, can also contain solid material components, contaminates critical parts such as bearings. In a case such as this the entire pumping device may often have to be over-hauled. For this reason the common housing or the pressure container is normally filled with a barrier fluid and a pressure regulating system ensures that the pressure of the barrier fluid in the housing or in the pressure container is higher than the pressure of the pumping medium in the pump unit in order to avoid the pumping medium from escaping into the housing or into the pressure container.

In current pressure regulating systems such as those used in underwater pumping devices for crude oil, either pressure/volume compensators are used or electro-hydraulic pressure valves. The use of pressure/volume compensators results in a comparatively complicated pressure regulating system with a correspondingly large number of components and connections. Furthermore, pressure/volume compensators contain elastic partition walls which are vulnerable to material fatigue. If electro-hydraulic pressure valves are used, an electronic pressure sensor and control is necessary and delays in the reaction time of the pressure regulation system result.

BRIEF SUMMARY OF THE INVENTION

It is the object of the invention to make available a method for the pressure regulation of a barrier fluid in a pumping device and also a pumping device for a method of this kind with which it can be ensured that the pressure of the barrier fluid is higher than the pressure of the pumping medium in the pump unit and which are simply and reliably built, manage with a few components for the pressure regulation and which have a comparatively short reaction time.

This object is satisfied by the method defined herein and by the pumping device defined herein.

In the method in accordance with the invention for the pressure regulation of a barrier fluid in a pumping device a pumping medium is pumped by the pumping device. To this end the pumping device includes a pump unit with a shaft and a pump housing, a drive unit, which is mechanically coupled to the pump unit and a shaft sealing arrangement, which seals the pump housing relative to the shaft. In the method, the barrier fluid is conveyed via a feed line to the shaft sealing arrangement and/or to a common housing, in which the pump unit and the drive unit are arranged, in order to prevent a leakage of the pumping medium out of the pump housing. In addition, the pressure of the supplied barrier fluid is increased when a pressure difference between the pressure of the supplied barrier fluid and a detected pressure of the pumping medium in the pump unit falls below a pre-determined value and to this end a differential pressure reducing valve is opened and the feed line is connected through to a source for the barrier fluid via the open valve, with the pressure of the barrier fluid lying above the pressure of the pumping medium in the pump unit. Its pressure advantageously lies above the pressure of the pumping medium in the pump unit by more than the pre-determined value. In an advantageous variant the valve is closed again when the pressure difference between the pressure of the supplied barrier fluid and the determined value of the pumping medium in the pump unit increases above a further predetermined value or the predetermined value.

In a further advantageous variant the pressure of the supplied barrier fluid is additionally lowered when a pressure difference between the pressure of the supplied barrier fluid and the detected pressure of the pumping medium in the pump unit exceeds a second predetermined value. To this end a differential pressure overflow valve is opened and barrier fluid is discharged via the opened valve, in particular via a connection line to the pump housing or via a return or a discharge for the barrier fluid. This second valve is advantageously closed again when the pressure difference between the pressure of the supplied barrier fluid and the detected pressure of the pumping medium in the pump unit lies below a further predetermined value or below the second predetermined value.

In a further advantageous variant heat is additionally removed from the pumping device, in particular heat of the drive unit, by circulating the barrier fluid in a cooling circuit with a heat exchanger.

The pumping device in accordance with the invention for the pumping of a pumping medium includes a pump unit with a shaft and a pump housing, a drive unit which is mechanically coupled to the pump unit, a shaft sealing arrangement which seals the pump housing relative to the shaft and a regulating system for the pressure regulation of a barrier fluid. The regulation system includes a source for a pressurised barrier fluid, which is connected via a feed line to the shaft sealing arrangement and/or to a common housing in which the pump unit and the drive unit are arranged, in order to supply barrier fluid and to prevent a leakage of the pumping medium from the pump housing. The regulating system additionally contains a pressure reducing valve for the differential pressure, which is arranged in the feed line, wherein the valve opens when a pressure difference prevailing at the valve between the pressure of the supplied barrier fluid and a determined pressure of the pumping medium in the pump unit falls below a pre-determined value, in order to raise the pressure of the supplied barrier fluid, and wherein the valve closes again as required when the pressure difference prevailing at the valve exceeds a further predetermined value or the predetermined value. The source or the reservoir is advantageously designed in such a way that the pressure of the barrier fluid made available from it lies more than the predetermined value above the pressure of the pumping medium in the pump unit.

In an advantageous variant the regulating system additionally contains a differential pressure overflow valve. This second valve opens when the pressure difference prevailing at this valve between the pressure of the supplied barrier fluid and a detected pressure of the pumping medium in the pump unit exceeds a second pre-determined value and this second valve closes again when required when the pressure difference prevailing at this valve exceeds a further predetermined value or the second predetermined value.

In a further advantageous embodiment the regulating system additionally contains a cooling circuit with a heat exchanger for the barrier fluid, in order take away heat from the pumping device such as, for example, heat of the drive unit.

In an advantageous embodiment the pressure valve or, if two pressure valves are used, each of the pressure valves has a control inlet for detecting pressure, which is connected to the pump unit in order to detect the pressure inside the pump unit, and an inlet and an outlet for the barrier fluid, wherein the inlet of the pressure reducing valve for the differential pressure is occasionally connected to a first part of the feed line for the pressurised barrier fluid, and the outlet of the differential pressure overflow valve and the inlet of the differential pressure overflow valve are each connected occasionally to a second part of the feed line and the outlet of the differential pressure overflow valve is connected occasionally to a second part of the connection line, which is connected to the pump housing or to a return line or a drain for the barrier fluid.

In a further advantageous embodiment the regulating system additionally contains one or more of the following components: a storage container for barrier fluid, a pump in order to increase the pressure of the barrier fluid, a reservoir for the pressurised barrier fluid, a circulating pump in order to circulate barrier fluid in a cooling circuit, a check valve in order to prevent the back flow of barrier fluid into the storage container and/or the reservoir and/or in order to prevent the back flow of pumping medium into the regulating system.

In an advantageous embodiment of the pumping device, this includes a common housing in which the pump unit and the drive unit are arranged, for example a housing which is formed as a pressure container.

The method according to the invention for the pressure regulation of a barrier fluid and the pumping device in accordance with the invention have the advantage that in order to maintain a desired pressure difference between the pressure of the supplied barrier fluid and the pressure of the pumping medium in the pump unit, only two pressure valves are required, which reduces the number of the components needed for the regulation of the pressure to a minimum. Furthermore, the pressure valves are directly activated by the pressure difference between the pressure of the supplied barrier fluid and the pressure of the pumping medium in the pump unit, as a result of which the reaction time of the pressure regulation can be kept short. It is also advantageous that the passive state of the pressure valves is determined by a spring, as a result of which in the event of a breakdown a clear behaviour of the valves is ensured. Due to the purely hydraulic coupling, signal transmission errors, such as can occur in electronic pressure regulation systems, are ruled out. The method in accordance with the invention for pressure regulation and the pumping device in accordance with the invention thus possess a high degree of reliability since only a few, exclusively mechanical components are required for the pressure regulation.

The above description of embodiments and variants merely serves as an example. Further advantageous embodiments are documented by the dependent claims and the drawing. Furthermore, within the scope of the present invention, individual features of the described or illustrated embodiments and variants can also be combined with one another to form new embodiments.

BRIEF DESCRIPTION OF THE DRAWINGS

The invention will be described in more detail on the basis of the embodiments and the drawing in which:

FIG. 1 shows an embodiment of a pumping device in accordance with the present invention.

DETAILED DESCRIPTION OF THE INVENTION

The embodiment shown in FIG. 1 of a pumping device for the pumping of a barrier fluid in accordance with the present invention includes a pump unit (11) with a shaft (12) and a pump housing (13), a drive unit (17), which is mechanically coupled to the pump unit and a shaft sealing arrangement (16.1, 16.2), which seals the pump housing (13) relative to the shaft (12) and a regulating system for the pressure regulation of a barrier fluid which is described in more detail in the following section. As shown in FIG. 1, the pump housing 13 is expediently provided with a pump inlet 15 and a pump outlet 14. The shaft sealing arrangement 16.1, 16.2 can for example be formed as a slide ring shaft seal, a brush seal arrangement and/or a stuffing box. With a through shaft 12 a respective shaft seal is provided on both sides of the pump housing 13. The drive unit 17 can, for example, as shown in FIG. 1, include an electric motor with a stator and a rotor, which is advantageously coupled to the shaft 12 of the pump unit. The pumping device can, depending on the specification, include a common housing 18, in which the pump unit 11 and the drive unit 17 are arranged, just as, occasionally, a plurality of bearings for the mounting of the shaft 12 or the drive rotor, for example one or more radial bearings 19.1-19.4 or one or more axial bearings 19.5, 19.6. The common housing 18 can be formed as a pressure container, for example for underwater applications, which seals the pump unit 11 and the drive unit 17 arranged therein relative to the outside.

The regulation system for the regulation of the pressure of a barrier fluid in accordance with the embodiment contains a source 3, 4 and/or a reservoir 6 for a barrier fluid standing under pressure and a feed line 5.1, 5.2 which is connected to the source or the reservoir in order to convey barrier fluid to a shaft sealing arrangement 16.1, 16.2 and/or to a common housing 18, in which the pump unit 11 and the drive unit 17 are arranged, in order to prevent a leakage of the pumping medium from the pump housing 13. The regulation system additionally contains a pressure reducing valve 1 for the differential pressure, which is arranged in the feed line 5.1, 5.2. The valve opens, when a pressure difference prevailing at the valve between the pressure of the supplied barrier fluid and a determined pressure of the pumping medium in the pump unit 11 falls below a pre-determined value, in order to raise the pressure of the supplied barrier fluid and the valve closes again on demand when the pressure difference prevailing at the valve exceeds a further predetermined value or the predetermined value. The source 3, 4 or the reservoir 6 are advantageously formed in such a manner that the pressure of the barrier fluid made available from this lies above the pressure of the pumping medium in the pump unit 11 by more than the predetermined value. The source 3, 4 can, for example, contain a storage container 3 for barrier fluid and/or a pump 4 in order to increase the pressure of the barrier fluid. The reservoir 6 can be designed as a pressure container. Non-corrosive liquids and/or liquid media with a lubricating action can be used as blocking media for example. It is however also possible to use a gaseous barrier fluid such as, for example, an inert gas.

In an advantageous variant the regulating system additionally contains a differential pressure overflow valve 2. This second valve opens when the pressure difference prevailing at this valve between the pressure of the supplied barrier fluid and a detected pressure of the pumping medium in the pump unit 11 exceeds a second pre-determined value and this second valve closes again on demand when the pressure difference prevailing at the valve exceeds a further predetermined value or a second predetermined value.

In a further advantageous variant the regulating system additionally contains a cooling circuit 20 with a heat exchanger 21 for the barrier fluid in order to take away heat from the pumping device 10, such as in particular heat of the drive unit 17. In the embodiment illustrated in FIG. 1 the barrier fluid is supplied to one side of the drive unit, for example, conducted in the common housing 18 around or through the drive unit, and taken away through the cooling circuit at the opposite side of the drive unit. A circulating pump 22 for circulating the barrier fluid can additionally be provided in the cooling circuit. The circulating pump can, for example, be arranged inside the common housing and can be mechanically coupled to the drive unit 17.

If a common housing 18 is provided in which the pump unit 11 and the drive unit 17 are arranged, the barrier fluid can in principle be supplied into this at any point. For example, as mentioned above, the barrier fluid coming out of the supply line 5.2 can be supplied to the shaft sealing arrangement 16.1, 16.2 and/or to one or more of the bearings 19.1-19.6 and/or fed into the cooling circuit 20 mentioned in the last section.

In an advantageous embodiment each of the pressure valves 1, 2 has a control inlet for pressure detection which is coupled to the inside of the pump unit 11 via a connection line 7, for example pneumatically or hydraulically, in order to detect the pressure inside the pump unit, and an inlet and an outlet for the barrier fluid, wherein the inlet of the pressure reducing valve for differential pressure is occasionally connected to a first part 5.1 of the supply line for the pressurised barrier fluid and the outlet of the pressure reducing valve 1 for differential pressure and the inlet of the differential pressure overflow valve 2 are occasionally respectively connected to a second part 5.2 of the supply line and the outlet of the differential pressure overflow valve is occasionally connected to a connection line 9, which is connected to the pump housing 13 or to a return flow or to a discharge for the barrier fluid. The return flow can, for example, communicate with a storage container 3 for the barrier fluid. The connection line 7, with which the control inlets for detecting pressure are connected to the inside of the pump unit 11, is advantageously connected to a place in the pump unit, where the pressure of the pumping medium is comparatively high and/or corresponds to the highest process pressure to be sealed by means of the shaft sealing arrangement 16.1, 16.2. To regulate the pressure each of the pressure valves 1, 2 can additionally be equipped with a second control inlet for pressure detection which, can be connected occasionally to the second part 5.2 of the supply line. To this end, as shown in FIG. 1, the second control inlet of the pressure reducing valve 1 for the differential pressure is connected to the outlet of the pressure reducing valve for the differential pressure and the second control inlet of the differential pressure overflow valve 2 is connected to the inlet of the latter.

In a further advantageous embodiment check valves 8.1-8.3 are provided, for example a check valve 8.1 between the first part 5.1 of the feed line and the storage container 3 of the source, in order to prevent the return flow of the barrier fluid into the storage container, and/or a check valve 8.2 in the first part 5.1 of the feed line, in order to prevent a return flow into the reservoir 6 and/or a check valve 8.3 in the connection line 9 to the inside of the pump in order to prevent the return flow of pumping medium into the regulating system.

An embodiment of the method in accordance with the invention for the pressure regulation of a barrier fluid in a pumping device will be described in the following with the help of the drawing. In the method a pumping medium is pumped by means of the pumping device 10. To this end the pumping device 10 includes a pump unit 11 with a shaft 12 and a pump housing 13, a drive unit 17, which is mechanically coupled to the pump unit and a shaft sealing arrangement 16.1, 16.2, which seals the pump housing 13 relative to the shaft 12. In the method, the barrier fluid is conveyed via a feed line 5.1, 5.2 to the shaft sealing arrangement and/or to a common housing 18, in which the pump unit 11 and the drive unit 17 are arranged, in order to prevent a leakage of the pumping medium out of the pump housing. The pressure of the supplied barrier fluid is additionally increased when a pressure difference between the pressure of the supplied barrier fluid and a detected pressure of the pumping medium in the pump unit 11 falls below a pre-determined value and to this end a pressure reducing valve 1 for the differential-pressure is opened, wherein the feed line 5.1, 5.2 is connected through to a source 3, 4 for the barrier fluid via the open valve, the pressure of which lies above the pressure of the pumping medium in the pump unit 11. The pressure of the source for the barrier fluid advantageously lies above the pressure of the pumping medium in the pump unit by more than the predetermined value. In an advantageous embodiment the pressure reducing valve 1 for the differential pressure is closed again when the pressure difference between the pressure of the supplied barrier fluid and the detected pressure of the pumping medium in the pump unit 11 rises above a further predetermined value or above the predetermined value.

In a further advantageous variant of the method the pressure of the supplied barrier fluid is additionally lowered when a pressure difference between the pressure of the supplied barrier fluid and the detected pressure of the pumping medium in the pump unit 11 exceeds a predetermined value. For this purpose a differential pressure overflow valve 2 is opened, for example via a connection line 9 to the pump housing 13 or via a return or via an outlet for the barrier fluid. The differential pressure overflow valve 2 is advantageously closed again when the pressure difference between the pressure of the supplied barrier fluid and the detected pressure of the pumping medium in the pump unit 11 sinks below a further predetermined value or below the second predetermined value.

In a further advantageous variant of the method heat is additionally removed from the pumping device 10, in particular heat of the drive unit 17, by circulating the barrier fluid in a cooling circuit 20 with a heat exchanger 21.

The pressure of the pumping medium in the pump unit 11 can vary, depending on the working conditions and the operating conditions. The pressure of the barrier fluid supplied via the feed line 5.1, 5.2, can likewise vary, primarily as a consequence of alterations in temperature, which cause a corresponding change in volume. The pressure of the pumping medium in the pump unit 11 is advantageously detected at a point where the highest pressure to be sealed by the shaft sealing arrangement 16.1, 16.2 arises, for example in a chamber, which is upstream of the shaft sealing arrangement 16.2 in the direction towards the inside of the pump housing 13.

The pressure of the pumping medium detected or determined in this manner will be termed the reference pressure $p_{ref}$ in the following. The above-described method and the above-described embodiments allow for the pressure difference Δp between the pressure of the supplied barrier fluid and the detected reference pressure $p_{ref}$ to be kept constant even if the operating conditions vary. The mode of operation of the pressure regulation will be explained in the following with the help of a numerical example. The given pressure values are to be understood merely as examples in this connection, since the method in accordance with the invention is applicable in a wide pressure range. For example the mean pressure difference Δp between the pressure of the supplied barrier fluid and the reference pressure $p_{ref}$ can lie between 5 bar and 50 bar or between 2 bar and 100 bar and the range of fluctuation of the regulated pressure difference can lie between +/−2 bar and +/−20 bar or between +/−0.5 bar and +/−30 bar.

In the following numerical example a pressure difference of Δp=20 bar should be kept constant within +/−5 bar. When the detected reference pressure $p_{ref}$ increases, the pressure difference Δp to the pressure of the supplied barrier fluid sinks. The pressure reducing valve 1 for the differential pressure opens when the pressure difference Δp sinks below a predetermined value, i.e. in the present case below 15 bar, with the feed line 5.1, 5.2 being connected through via the open valve to the source 3, 4 and to the pressurised reservoir 6 for the barrier fluid, and the pressure of the supplied barrier fluid is increased correspondingly. As soon as the pressure difference Δp increases above a further predetermined value, i.e. in the present case above 20 bar, the pressure reducing valve 1 for the differential pressure is closed again. In the opposite case, when the detected reference pressure $p_{ref}$ falls, then the pressure difference Δp increases relative to the pressure of the supplied barrier fluid. The differential pressure overflow valve 2 opens when the pressure difference Δp lies above a predetermined second value, i.e. in the present case above 25 bar, with barrier fluid being discharged via the open valve, for example via a connection line 9 to the pump housing 13. As soon as the pressure difference Δp falls below a further predetermined value, i.e. in the present case below 20 bar, the differential pressure overflow valve 2 is closed again. In this manner the pressure difference Δp=20 bar between the pressure of the supplied barrier fluid and the reference pressure $p_{ref}$ is kept constant within +/−5 bar.

The described method for the pressure regulation of a barrier fluid in a pumping device and the described pumping device are simple and reliable and permit the pressure difference between the pressure of the supplied barrier fluid and the pressure of the pumping medium in the pump unit to be maintained under changing working conditions and operating conditions.

The invention claimed is:

1. A method for the pressure regulation of a barrier fluid in a pumping device, the pumping device comprising a pump unit comprising a shaft and a pump housing, the pumping device further comprising a drive unit, which is mechanically coupled to the pump unit, the pumping device further comprising a shaft seal, which seals the pump housing relative to the shaft, the method comprising:

pumping a pumping medium is pumped by means of the pumping device;

conveying the barrier fluid via a feed line to the shaft seal and/or to a housing in which the pump unit and the drive unit are disposed, in order to prevent a leakage of the pumping medium out of the pump housing;

increasing the pressure of the supplied barrier fluid when a pressure difference between the pressure of the supplied barrier fluid and a pressure of the pumping medium in the pump unit falls below a first pre-determined value by opening a pressure reducing valve for the differential pressure to thereby connect the feed line to a source for the barrier fluid via the open valve, the pressure of the barrier fluid lying above the pressure of the pumping medium in the pump unit;

wherein opening the pressure reducing valve comprises directly activating the pressure reducing valve by the pressure difference between the pressure of the supplied barrier fluid and the pressure of the pumping medium in the pump unit.

2. The method in accordance with claim 1, further comprising decreasing the pressure of the supplied barrier fluid, when the pressure difference between the pressure of the supplied barrier fluid and the pressure of the pumping medium in the pump unit exceeds a second pre-determined value by opening a differential pressure overflow valve and discharging barrier fluid via the differential pressure overflow valve.

3. The method in accordance with claim 1, further comprising removing heat from the pumping device by circulating barrier fluid in a cooling circuit with a heat exchanger.

4. The method in accordance with claim 1, further comprising closing the pressure reducing valve with a spring, when the pressure difference does not fall below the first pre-determined value.

5. A pumping device for the pumping of a pumping medium, comprising:

a pump unit comprising a shaft and a pump housing, a drive unit which is mechanically coupled to the pump unit;

a shaft seal which seals the pump housing relative to the shaft; and a regulating system for pressure regulation of a barrier fluid, comprising:

a source for a pressurised barrier fluid, which is connected via a feed line to the shaft seal and/or to a housing in which the pump unit and the drive unit are disposed, in order to supply the barrier fluid and to prevent a leakage of the pumping medium from the pump housing; and a pressure reducing valve for differential pressure, which is disposed in the feed line, wherein the pressure reducing valve opens by being directly activated by a pressure difference prevailing at the pressure reducing valve between a pressure of the supplied barrier fluid and a pressure of the pumping medium in the pump unit when the pressure difference falls below a first pre-determined value, in order to raise the pressure of the supplied barrier fluid.

6. The pumping device in accordance with claim 5, wherein the regulating system further comprises a differential pressure overflow valve which opens when the pressure difference prevailing at the differential pressure overflow valve between the pressure of the supplied barrier fluid and the pressure of the pumping medium in the pump unit exceeds a second pre-determined value.

7. The pumping device in accordance with claim 6, wherein each of the valves comprises:

a control inlet for detecting pressure, which is connected to the pump unit in order to detect the pressure inside the pump unit;

an inlet and an outlet for the barrier fluid; and an outlet for the barrier fluid;

wherein the control inlet of the pressure reducing valve is connected to a first part of the feed line;

wherein the outlet of the pressure reducing valve and the inlet of the differential pressure overflow valve are connected to a second part of the feed line; and wherein the outlet of the differential pressure overflow valve is connected to a connection line which is connected to the pump housing, to a return line, or to a drain for the barrier fluid.

8. The pumping device in accordance with claim 5, wherein the regulating system further comprises a cooling circuit comprising a heat exchanger for the barrier fluid, configured to take away heat from the pumping device.

9. The pumping device in accordance with claim 5, wherein the regulating system further comprises at least one member of the group consisting of:

a storage container for the barrier fluid, a pump configured to increase the pressure of the barrier fluid, a reservoir for the barrier fluid, a circulating pump configured to circulate the barrier fluid in a cooling circuit, a first check valve configured to prevent back flow of the barrier fluid into the storage container and/or into the reservoir, and a second check valve configured to prevent the back flow of pumping medium into the regulating system.

10. The pumping device in accordance with claim 5, further comprising the housing in which the pump unit and the drive unit are disposed, wherein the housing is a pressurised container.

11. The pumping device in accordance with claim 5, wherein the pressure reducing valve is closed by a spring when the pressure difference does not fall below the first pre-determined value.

* * * * *